US005956922A

United States Patent [19]

Liuska

[11] Patent Number: 5,956,922

[45] Date of Patent: Sep. 28, 1999

[54] WALL FORMING SYSTEM AND METHOD OF FORMING A WALL OF HARDENABLE MATERIAL

[76] Inventor: Bruce Liuska, 7071 Woodhue La., Las Vegas, Nev. 89117

[21] Appl. No.: 08/951,649

[22] Filed: Oct. 16, 1997

[51] Int. Cl.[6] ..... E04G 21/02

[52] U.S. Cl. ..... 52/745.09; 249/43; 249/216; 249/219.1; 264/31

[58] Field of Search ..... 249/33, 40, 43, 249/189, 190, 213, 216, 217, 218, 219.1, 219.2; 52/745.05, 745.09; 264/31, 33

[56] References Cited

U.S. PATENT DOCUMENTS

| | | | |
|---|---|---|---|
| 314,398 | 3/1885 | Ransome . | |
| 1,244,958 | 10/1917 | Coly | 249/40 |
| 1,270,793 | 7/1918 | Davidson . | |
| 1,543,491 | 6/1925 | Beghetti . | |
| 2,161,379 | 6/1939 | Neptune . | |
| 2,614,311 | 10/1952 | Shook . | |
| 3,910,546 | 10/1975 | Connors . | |
| 4,052,031 | 10/1977 | Melfi | 249/43 |
| 4,147,322 | 4/1979 | Dahlstrom . | |
| 4,208,030 | 6/1980 | Wilson . | |
| 4,234,156 | 11/1980 | Wepf . | |
| 4,247,073 | 1/1981 | Vario . | |
| 4,254,932 | 3/1981 | Durbin . | |
| 4,726,560 | 2/1988 | Dotson . | |

*Primary Examiner*—Michael Safavi
*Attorney, Agent, or Firm*—Parsons & Goltry; Robert A. Parsons; Michael W. Goltry

[57] ABSTRACT

A wall forming system and method having a parallel form panels secured together by an adjustable support structure to form a cavity therebetween. The cavity being filled with hardenable material. The support structure having an elongated threaded member with a adjustable frame mounted upon the threaded member along either side of the parallel form panels. Mounts are placed upon the threaded member and rotated to hold the frame in position against the form panels. Rotation of the mounts can serve to impart a curvature to the forming system.

5 Claims, 7 Drawing Sheets

FIG. 3
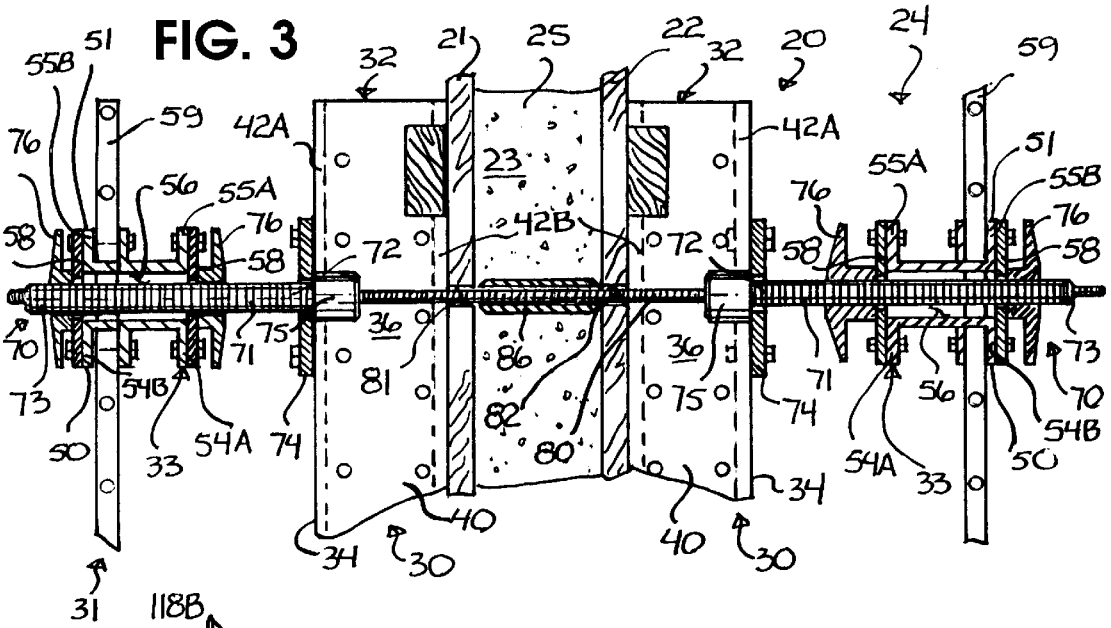
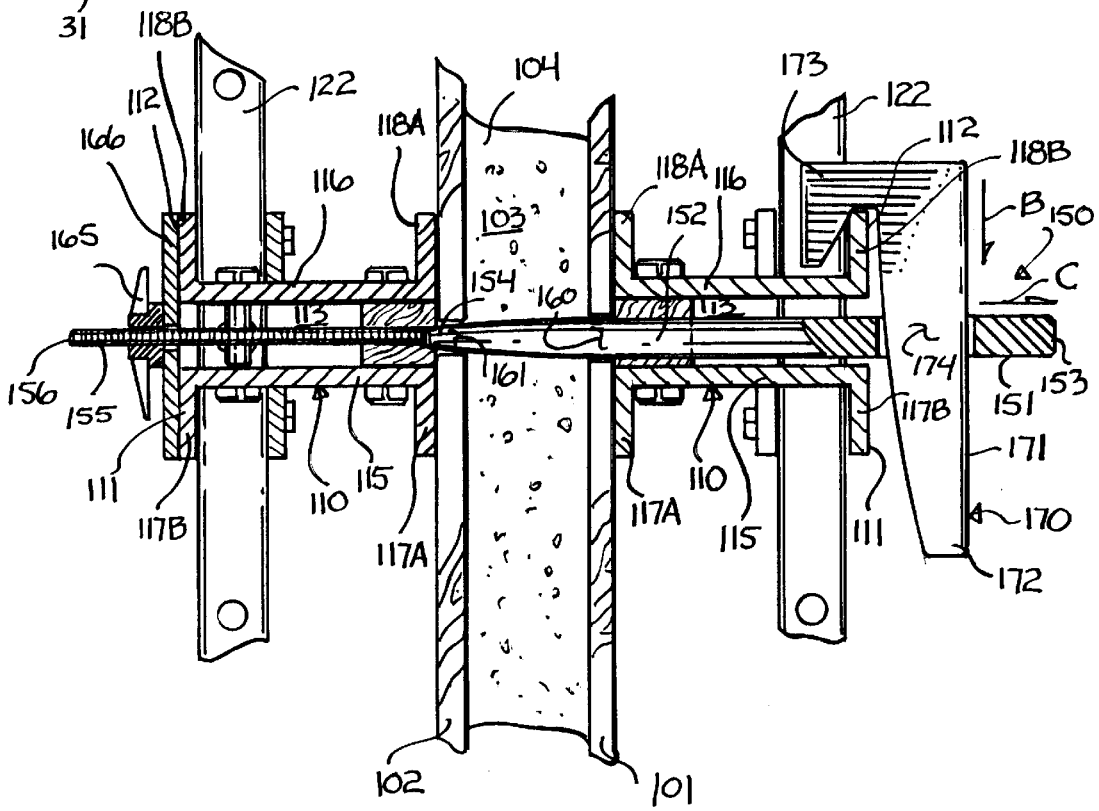
FIG. 5

WALL FORMING SYSTEM AND METHOD OF FORMING A WALL OF HARDENABLE MATERIAL

BACKGROUND OF THE INVENTION

1. Field of the Invention

This invention relates generally to the field of wall forming systems.

More particularly, this invention relates to systems for molding hardenable material.

In a further and more specific aspect, the present invention relates to a wall forming system for molding hardenable material and a method of forming a wall of hardenable material.

2. Prior Art

A common system and method of forming or erecting concrete walls to serve as foundations for building construction, retaining walls or for other desired purpose is to pour wet concrete into a cavity bound by substantially planar or perhaps non-planar panels or forms. Once poured, the concrete is allowed to harden thus taking the form of the cavity. After the concrete has hardened, the forms may be disassembled to expose the concrete wall. The forms are substantially rigid and are normally constructed of wood, metals, plastics and perhaps composite materials. The forms are typically reinforced with brace or support structures to hold them in place and prevent them from breaching under the weight of the concrete. In most instances, tie rod assemblies span the cavity between the panels to interconnect the brace or support structures to maintain the forms in a predetermined and desired orientation relative one another.

The construction of concrete walls in the foregoing manner is a very labor intensive and arduous task. To increase the ease and efficiency of constructing concrete walls, a variety of exemplary apparatus have been provided that have eliminated much of the frustration and laborious efforts normally commonplace in the industry. To this end, forms have been made lighter and stronger and support structures have taken on a variety of exemplary designs to enhance ease of operation, installation and disassembly.

Although the construction of linear or straight concrete walls has proven to occasion little technological and practical difficulty, the construction of radial or radius walls has long been a difficult and time consuming task. In some instances, skilled artisans have constructed radius walls with a plurality of small forms constructed together to form a desired radial dimension. However, this technique is often quite difficult, tedious, slow and extremely labor intensive. Alternatively, radial forms have been constructed of varying radial dimension to aid workers in constructing radial aspects into concrete wall. However, the construction of radial forms is expensive and not widely implemented.

Consistent with the foregoing discussion, concrete walls may be formed of varying height and thickness. For concrete walls of over four feet in height, it may become necessary to employ an auxiliary support structure adjacent the forms for supporting workers and equipment. Although considerable effort has been employed to enhance the ease and manner of forming concrete walls, little or no effort has been invested toward the improvement of auxiliary support structures of the foregoing variety.

It would be highly advantageous, therefore, to remedy the foregoing and other deficiencies inherent in the prior art.

Accordingly, it is an object of the present invention to provide a new and improved wall forming system for constructing walls with hardenable material such as concrete.

Another object of the present invention is to provide a wall forming system that is highly efficient.

And another object of the present invention is to provide a wall forming system that is easy to use.

Still another object of the present invention is to provide a wall forming system that is easy to construct.

Yet another object of the instant invention is to provide a wall forming system that includes a support structure for supporting a form and an auxiliary support engagable with the support structure to serve as a scaffle for supporting workers and tools.

Yet still another object of the instant invention is to provide a wall forming system including an adjustable support structure for supporting a form for imparting a predetermined and desired radius or contour to the form.

And a further object of the invention is to provide a wall forming system that is convenient and easy to use.

Still a further object of the immediate invention is to provide a new and improved method of forming a wall from hardenable material.

Yet a further object of the invention is to provide a new and improved method of forming a contour or radius from hardenable material.

And still a further object of the invention is the provision of an adjustable support structure that is easy and convenient to construct.

SUMMARY OF THE INVENTION

Briefly, to achieve the desired objects of the instant invention in accordance with a preferred embodiment thereof, provided is a system and method of forming a cast for molding hardenable material. The system includes a first panel, a second panel opposing the first panel to bound a cavity for receiving hardenable material. Further included is a first support structure mounted with at least one of the panels and a second support structure engagable to serve as an auxiliary support for the support structure. The second support structure includes a plurality of structural members engagable at predetermined and selected locations with the first support structure and engagable with one another to form an architecture such as a scaffle for supporting workers and tools.

Another system and method of forming a cast for molding hardenable material may comprise a first panel, a second panel opposing the first panel to bound a cavity for receiving hardenable material and an adjustable support structure engagable with at least one of the panels for imparting a contour to the at least one of the panels. The adjustable support structure is generally comprised of a first element engagable with the at least one of the panels, a second element opposing and the first element, and adjustment means interconnecting the first element with the second element for adjusting the distance between the first element and the second element. The adjustment means may include an elongate member having a first end mounted with the first element and a second end mounted for adjustment with the second element and means carried by the elongate member for fixing the elongate member to the second element and for facilitating selected reciprocal adjustment of the elongate member relative the second element.

BRIEF DESCRIPTION OF THE DRAWINGS

The foregoing and further and more specific objects and advantages of the instant invention will become readily apparent to those skilled in the art from the following detailed description a preferred embodiment thereof taken in conjunction with the drawings in which:

FIG. 3 illustrates a sectional view taken along line 3—3 of FIG. 2;

FIG. 5 illustrates a sectional view taken along line 5—5 of FIG. 4;

DETAILED DESCRIPTION OF THE PREFERRED EMBODIMENT

Figure 1:
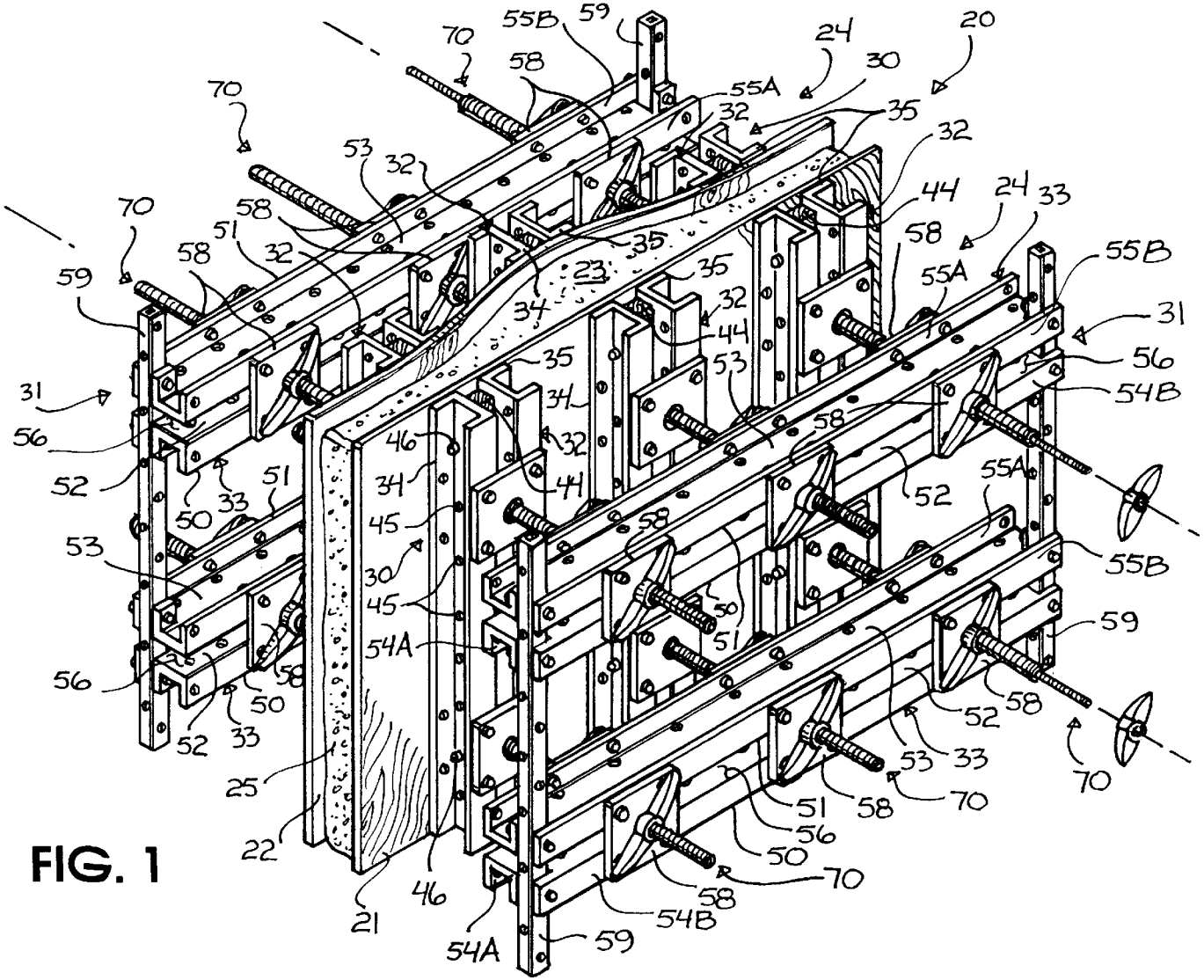
FIG. 1 illustrates an isometric view of a segment of a wall forming system for forming a radial or contoured wall from hardenable material, in accordance with a preferred embodiment of the present invention.

Turning now to the drawings, in which like reference characters indicate corresponding elements throughout the several views, attention is first directed to FIG. 1 which illustrates an isometric view of a segment of a wall forming system or cast generally designated by the reference character 20, in accordance with a preferred embodiment of the present invention. Wall forming system 20 is operative for facilitating the formation of a radial or contoured wall from hardenable material such as concrete. Wall forming system 20 includes a first form or panel 21 and a second form or panel 22 opposing first panel 21 to bound a space or cavity 23 for receiving a hardenable material 25. First panel 21 and second panel 22 are each supported by an adjustable brace or support structure, each being generally designated by the reference character 24. Each adjustable support structure 24 operates not only to hold first and second panels 21 and 22 in place and to prevent them from breaching under the weight of the concrete, but also to allow a user to impart a radius or contour to either first panel 21 and/or second panel 22 in an exemplary manner to be presently discussed. Consistent with conventional practice, once poured within cavity 23, the hardenable material 25 will harden or cure thus taking the form of the cavity 23. After the hardenable material 25 has hardened, the wall forming system 20 may be disassembled to expose the concrete wall.

Each adjustable support structure 24 is the mirror image of the other and is generally comprised of a first framework generally designated at 30 that may be erected and mounted with each respective first and second panel 21 and 22. First framework 30 is coupled with a second framework 31 in adjustable and supporting relation. First framework 30 is comprised of a plurality of first elements 32 mounted in spaced apart and substantially parallel relation. Second framework 31, spaced from first framework 30, is comprised of a plurality of second elements 33 mounted in spaced apart and substantially parallel relation substantially perpendicular to first elements 32. In the example illustrated in FIG. 1, a total of three first elements 32 are shown in combination with first framework 30, and a total of two second elements 33 are shown in combination with second framework 31. However, this is not essential and more or less first and second elements 32 and 33 may be used depending upon the needs of the user and the height and width of the wall to be formed.

Figure 2:
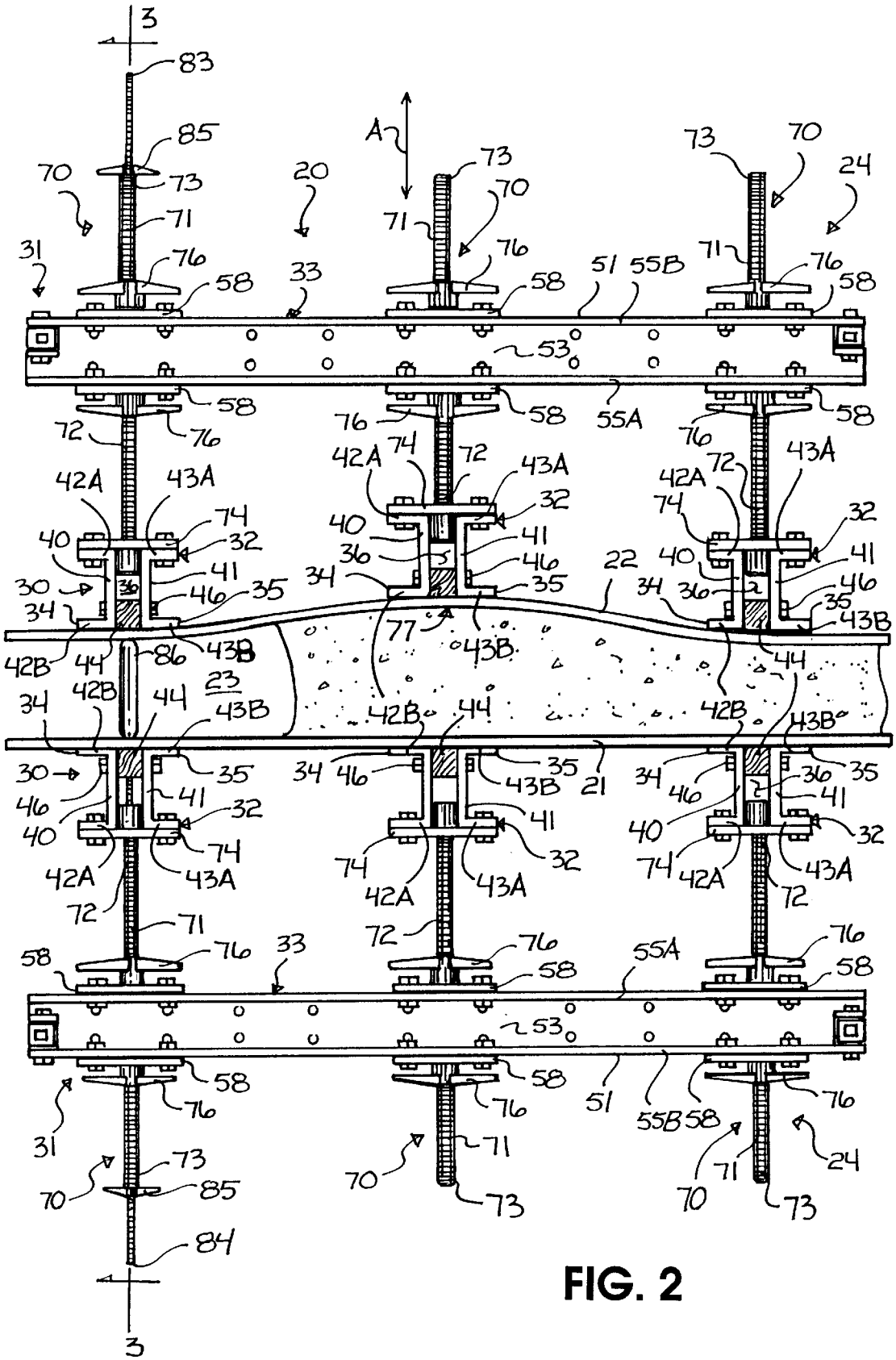
FIG. 2 illustrates a top plan view of the wall forming system of FIG. 1.

Commonly referred to as stiffbacks by those skilled in the art, each first element 32 is substantially rigid, formed generally in the shape of an "H" and includes substantially co-extensive first and second generaly U-shaped support members 34 and 35 mounted in spaced apart and substantially parallel relation relative one another to form a gap or space 36 therebetween as best shown in FIG. 2 illustrating a top plan view of the wall forming system 20 of FIG. 1. Regarding FIG. 2, each U-shaped support member 34 and 35 is elongate and includes an endwall 40 and 41 and spaced apart sidewalls 42A and 42B, and 43A and 43B, respectively. Endwalls 40 and 41 are adjoined in spaced relation with a spacer 44 therebetween coincide or otherwise substantially flush with sidewall 42A and 43A of each respective U-shaped support member 34 and 31 with sidewalls 42A, 42B, 43A and 43B of each U-shaped support member 34 and 35, respectively, extending in opposing directions. Each U-shaped support member 34 and 35 includes a plurality of substantially linearly aligned and spaced apart apertures 45 (FIG. 1) extending through endwall 40 and 41 along substantially the entire length thereof somewhat inboard of sidewall 42A and 43A, respectively. One or more conventional nut and bolt fastening mechanisms (FIG. 1 and FIG. 2) 46 may be received by opposing apertures 45 and spacer 44 to fasten first U-shaped support member 34 with second U-shaped support member 35 and with spacer 44, although other suitable fastening mechanisms may be used without departing from the nature and scope of the present invention as herein specifically described. Furthermore, each U-shaped support member 34 and 35 may also include a plurality of substantially linearly aligned and spaced-apart apertures extending thorough endwall 40 and 41 along substantially the entire length thereof somewhat inboard of sidewall 42B and 43B if desired and employed for fastening the U-shaped support members 34 and 35 together in the manner thus described if so desired for ease and convenience, although this is not essential.

Each spacer 44 is preferably constructed of wood. To fasten or mount each first element 31 with each respective first and second panel 21 and 22, a user may drive nails, screws or other similar fasteners through each spacer 44 for receipt by each respective first and second panel 21 and 22.

Regarding FIG. 1, each second element 33 of second framework 31 is substantially rigid and includes substantially coextensive first and second generally U-shaped support elements 50 and 51 mounted in spaced apart and substantially parallel relation relative one another in an orientation similar to the orientation of each first and second U-shaped support member 34 and 35 of each first element 32 of first framework 30. In this regard, each U-shaped support element 50 and 51 is elongate and includes an endwall 52 and 53 and spaced apart sidewalls 54A and 54B, and 55A and 55B, respectively. Endwalls 52 and 53 are adjoined in spaced relation to form a space 56 therebetween with rigid plates 58 mounted with sidewalls 54A and 55A, and 54B and 55B in substantially diametrically opposed relation on either lateral side of each second element 33. Plates 58 are each preferably square in shape and may be mounted at either corner thereof with conventional nut and bolt assemblies or other suitable fastening mechanism. Second elements 33 are preferably coupled together in spaced apart and substantially parallel relation with elongate support elements 59, one being mounted with and interconnecting the respective ends of second elements 33 by virtue of nut and bolt assemblies or perhaps other suitable mechanical engagement mechanism.

Each second element 33 is mounted with each first element 32 by virtue of an adjustment assembly, each being generally designated by the reference character 70. With attention directed to FIG. 2, each adjustment assemble 70 is generally comprised of an elongate member 71 having a first end 72 and a second end 73. With additional reference to FIG. 3 illustrating a sectional view taken along line 3—3 of FIG. 2, elongate member 71 is mounted for reciprocating adjustment with second element 33 with first end 72 fixed or otherwise mounted with first element 32. Elongate member 71 traverses or otherwise extends through space 56. Although first end 72 of elongate member 71 may be secured with each first element 32 by virtue of any desired mechanical engagement means, first end 72 of each elongate member 71 may be fixed with a plate 74 engagable with sidewals 42A and 43A of first support element 32 by virtue of conventional nut and bolt engagement assemblies receivable through spaced apart apertures formed through sidewals 42A and 43A. A threaded sleeve carried by first end 72, receivable within space 36 and mounted with plate 74 further captures or otherwise secures first end 72 with plate 74.

To facilitate the selected reciprocal adjustment of elongate member 71, and consistent with a preferred embodiment, elongate member 71 is preferably threader. To this end, and with continuing reference to FIG. 3, threaded mounts or wing nuts 76 are threadably receivable by elongate member 71, one located on either lateral side of each second element 33. Wing nuts 76 serve to capture or otherwise allow the selective securement of second element 33 with elongate member 71. In this regard, each wing nut 76 may be threadably rotated in a predetermined direction to bear each wing nut 76 against a respective plate 58 to secure elongate member 71 with second element 33 at predetermined and selected locations along substantially the entire length of elongate member 71.

With reference back to FIG. 2, wing nuts 76 facilitate the selective detachable engagement of each elongate member 71 with each second element 33. In operation, a user may rotate respective ones of the wing nuts 76 capturing elongate element 71 with a corresponding second element 33 in a predetermined rotational direction to disengage the respective wing nuts 76 from plates 58 to correspondingly disengage elongate element 71 from a fixed position relative second element 33. Once disengaged, a user may continue to rotate the respective wing nuts 76 to threadably traverse the wing nuts 76 along elongate member 71 to space them apart from plates 58. A user may then urge elongate member reciprocally in the directions indicated by the double arrowed line A through space 56 (not shown in FIG. 2) bound by each support element 50 and 51 to vary the distance between second element 33 and a corresponding first element 32 of first framework 30. With each first element 32 mounted with a respective one of first and second panels 21 and 22, the selected reciprocal adjustment of elongate member 71 of a selected one of the adjustment assemblies 70 will operate to selectively pull or push first panel 21 and/or second panel 22 either toward or away from second framework 31 to thereby impart a substantially convex and/or substantially concave contour or radius to first panel 21 and/or second panel 22. In this manner, either one or more of the first elements 32 mounted with the first and second panels 21 and 22 may be adjusted from a substantially planar orientation to a substantially non-planar orientation to form a desired contour or radius as determined by the specific needs of the user in response to adjustment of either one or more of the adjustment assemblies 70.

To impart a contour or radius to first and/or second panels 21 and 22 at locations defined by either one or more of the first elements 32, second framework 31 is desired to be maintained in a substantially fixed location relative a selected one or more of the first elements 32 desired to be adjusted. If second framework 31 were not maintained in a substantially fixed location relative a selected one or more of the first elements 32 desired to be adjusted, second framework 31 would move relative first framework 30 to frustrate the desired and selected adjustment of one or more of the first elements 32 of first framework 30. Thus, and in accordance with preferred practice, second framework 31 may be mounted at a fixed location relative first framework 30 by means of stakes, braces or other conventional technique. Alternatively, with the elongate member 71 of each adjustment assembly 70 fixed to a respective one of the second elements 33, a user may selectively adjust a single adjustment assembly 70 at a time to impart a selected contour or radius to either first panel 21 and second panel 22 at one or more selected locations along either first panel 21 and/or second panel 22. In this manner of adjustment, second framework 31 will remain fixed relative first framework 30 to facilitate the desired adjustment of one or more of the first elements 32 of first framework 30 to form a substantially concave contour or radius or a substantially convex contour or radius as shown formed in second panel 22 generally designated at 77 in FIG. 2.

In FIG. 2, although a plurality of first elements 32 and corresponding adjustment assemblies 70 have been disclosed, a single first element 32 and a corresponding adjustment assembly 70 need only be employed for imparting a desired contour to a form or panel. Therefore, the plurality of such elements disclosed in combination with FIGS. 1–3 have been presented merely for the purposes of discussion. Therefore, the combination of a plurality of first elements 32 and a corresponding plurality of adjustment assemblies is not intended to be a limiting feature. Furthermore, to facilitate the formation of a radius or contour with either first and second panels 21 and 22, first and second panels 21 and 22 are preferably somewhat flexible to accommodate adjustment from a substantially planar orientation to a substantially non-planar orientation. Thus, first and second panels 21 and 22 may be constructed of plywood or other material that may be flexed or otherwise adjusted from a substantially planar orientation to a substantially non-planar orientation.

With attention directed back to FIG. 3, it may be desirable to join or otherwise engage opposing adjustable support structures together to hold first and second panels 21 and 22 in place so that the force and weight of the hardenable material or concrete deposited within cavity 23 will not blow out the first and second panels 21 and 22. In this regard, each opposing elongate member 71 may be made tubular to receive a tie rod 80. Tie rod 80 is preferably substantially rigid and may be received into and through opposing elongate members 71 and through opposing apertures 81 and 82 formed through first and second panels 21 and 22, respectively. As shown in FIG. 2, tie rod 80 includes outer ends 83 and 84 each terminating at a point outboard of second end 73 of each respective and opposing elongate members 71. To secure tie rod 80 relative each elongate member 71, tie rod may be threaded to receive threaded mounts or wing nuts 85 that may be rotated in a predetermined direction for bearing each respective wing nut 85 with the second end 73 of each respective elongate member 71 to substantially immobilize tie rod 80 relative each respective elongate member 71 of each respective adjustment assembly. A disposable sleeve 86 may be mounted to substantially encompass tie rod 80 within cavity 23 so that tie rod may be removed from cavity 23 after the hardenable material or concrete has cured or dried to take the form of cavity 23 upon disassembly of wall forming system 20 thus leaving sleeve 86 within the hardenable material.

Figure 4:
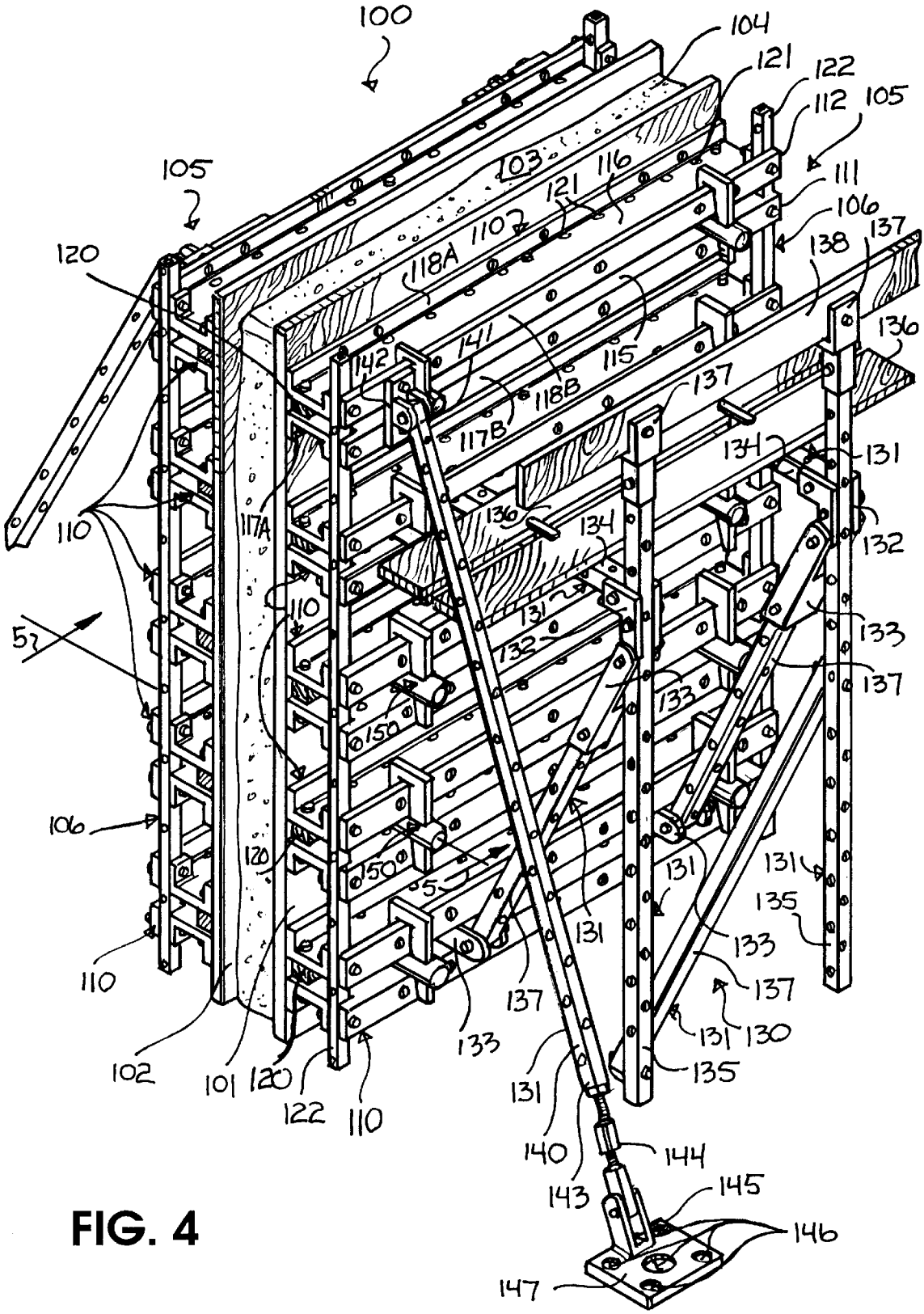
FIG. 4 illustrates a segment of a wall forming system for forming a wall of hardenable material including spaced apart forms each supported by a support structure including a plurality of support elements interconnected by a pair of elongate members, each support structure having an auxiliary support structure mounted thereto, in accordance with an alternate embodiment of the present invention.

Attention is now directed to FIG. 4 illustrating an alternate embodiment of a segment of a wall forming system or cast generally designated by the reference character 100. Wall forming system 100 is operative for forming a wall from hardenable material such as concrete, in accordance with an alternate embodiment of the present invention. Wall forming system 100 includes a first form or panel 101 and a second form or panel 102 opposing first panel 101 to bound a space or cavity 103 for receiving a hardenable material 104 such as concrete. First panel 101 and second panel 102 are each supported by a brace or support structure, each being generally designated by the reference character 105. Each support structure 105 desirably operates to hold first and second panels 101 and 102 in place and to prevent them from breaching under the weight of the concrete. Like wall forming system 20, and consistent with conventional practice, once poured within cavity 103, the hardenable material 104 will harden or cure thus taking the form of the cavity 103. After the hardenable material 104 has hardened, the wall forming system 100 may be disassembled to expose the concrete wall.

Figure 6:
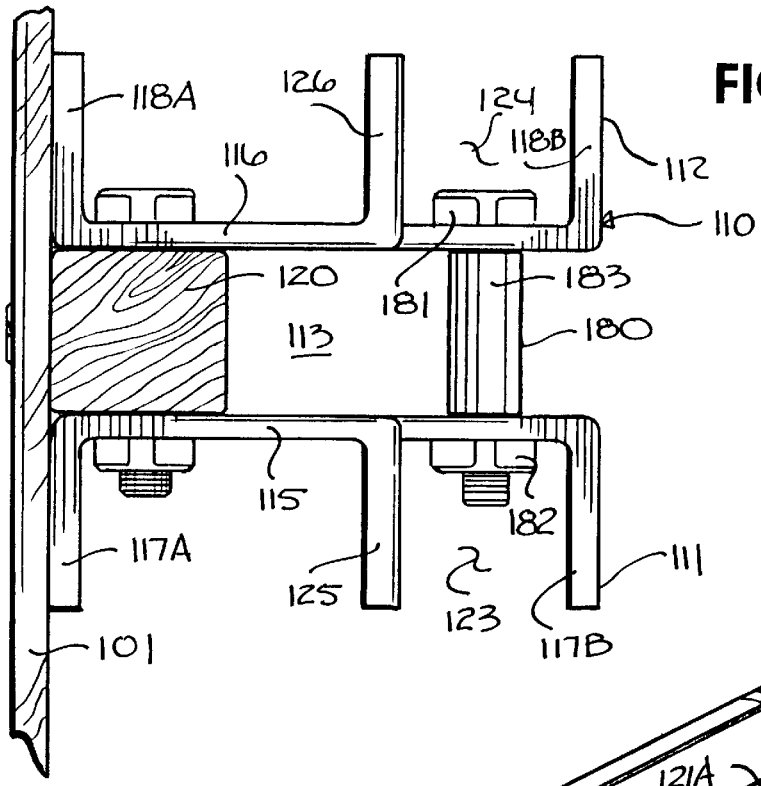
FIG. 6 illustrates a side view of one of the plurality of support elements of FIG. 4.

Each support structure 105 is generally comprised of a first support structure 106 that may be erected and mounted with each respective first and second panel 101 and 102. First support structure 106 includes a framework comprised of a plurality of spaced-apart substantially parallel support elements 110 commonly referred to as whalers by those skilled in the art. With momentary reference to FIG. 6 illustrating a side elevational view of one of the plurality of support elements 110, each support element 110 is substantially rigid, formed generally in the shape of an "H" and includes substantially co-extensive first and second generally U-shaped support members 111 and 112 mounted in spaced-apart and substantially parallel relation relative one another to form a gap or space 113 therebetween. Each U-shaped support member 111 and 112 is elongate and includes an endwall 115 and 116 and spaced apart sidewalls 117A and 117B, and 118A and 118B, respectively. Endwalls 115 and 116 are adjoined in spaced relation with a space 120 therebetween coincident or otherwise substantially flush with sidewall 117A and 118A of each respective U-shaped support member 111 and 112 with sidewalls 117A, 117B 118A and 118B of each U-shaped support member 111 an( 112, respectively, extending in opposing directions.

Each U-shaped support member 111 and 112 includes a plurality of substantially linearly aligned and spaced-apart apertures 121A (FIG. 7) extending along substantially the entire length thereof somewhat inboard of sidewall 117A (not shown) and sidewall 118A. One or more conventional nut and bolt fastening mechanisms (FIG. 6) 46 may be received by opposing apertures 121A (not shown in FIG. 6) and spacer 120 to fasten first U-shaped support member 111 with second U-shaped support member 112 and with spacer 120, although other suitable fastening mechanisms may be used without departing from the nature and scope of the present invention as herein specifically described. Furthermore, each U-shaped support member 111 and 112 may also include a plurality of substantially linearly aligned and spaced-apart apertures 121B (FIG. 7) extending along substantially the entire length thereof somewhat inboard of sidewall 117B and 118B if desired and used for fastening the U-shaped support members 111 and 112 together in the manner thus described for ease and convenience, although this is not essential.

Support elements 110 are preferably coupled together in spaced apart and substantially parallel relation with elongate support elements 122. Each support element 122 is mounted with and interconnects respective ends of each support element 110 by virtue of nut and bolt assemblies, although this is not essential and other suitable mechanical engagement mechanism may be used if desired. Regarding FIG. 6, first and second U-shaped support member 111 and 112 each define a channel 123 and 124 formed at either end thereof bound by an upstanding flange 125 and 126 and a portion of sidewall 117B and 118B, respectively. Each elongate support element 122 resides within each of the channels 123 and 124 and is desirably secured with flange 125 and 126 and sidewall 117B and 118B, respectively, of each support element 110 by virtue of a nut and bolt fastening assembly or other conventional fastening assembly.

Each spacer 120 is preferably constructed of wood. To fasten or mount each support element 110 with each respective first and second panel 101 and 102, a user may drive nails, screws or other similar fasteners through each spacer 120 for receipt by each respective first and second panel 101 and 102.

Support structure 105 may further includes a second support structure 130 engagable with first support structure 106. Second support structure 130 includes a plurality of elongate structural members 131 engagable at predetermined and selected locations with first support structure 106 and engagable with one another to form a predetermined and desired architecture. In particular, each structural member 131 is square in cross-section and includes a plurality of apertures formed therethrough at spaced-apart locations along substantially the entire length thereof. Each end of each structural member 131 may be inserted within space 113 of a selected support element 110 at predetermined and selected locations along substantially the entire length thereof and fastened to the support element 110 by virtue of a conventional nut and bolt fastening assembly or other similar fastening assembly receivable into and through opposed apertures formed through endwalls 115 and 116 and through a selected aperture carried by the end of the structural member 131. Furthermore, the ends of each structural member 131 may further be coupled or fastened with other structural members 131 at predetermined and selected locations by virtue of brackets 132 and connectors 133 having apertures operative for receiving pins, nut and bolt fastening mechanisms or other similar engagement mechanisms. As a consequence, with a plurality of structural member 131 provided of varying and predetermined lengths, brackets 132 and connectors 133, a user may construct and engage a desired architecture with first support structure 106.

To this end, FIG. 4 illustrates a pair of structural members 131 mounted with first support structure 106 to serve as substantially horizontal elements 134 extending outwardly from first support structure 106 and terminating with free ends each mounted via bracket 132 with a structural member 131 to serve as substantially vertical or upright elements 135 to form an auxiliary support structure herein shown as a scaffle architecture. Planks 136 supported by substantially horizontal elements 134 operate to support workers and tools for allowing workers to easily access and work on wall forming system 100 with substantially vertical elements 135 terminating with free ends having brackets 137 operative for carrying a plank 138 to serve as a rail for allowing workers to grasp and for preventing workers from falling off the scaffle architecture. Structural members 131 serving as supporting elements 137 are also provided, one interconnecting the substantially vertical elements 135 and one each interconnecting a respective substantially vertical element 135 with first support structure 106 to add strength and reinforce the scaffle architecture.

Consistent with the foregoing discussion, a user may mount a structural member 131 to serve as a brace 140 having an upper end 141 coupled with a bracket 142 mounted with a selected one of the plurality of support elements 110 and a lower end 143 mounted with a turnbuckle 144 coupled with a brace 145 to rest upon the ground. Stakes (not shown) may be pounded into the ground through one or more apertures 146 formed through a base 147 of brace 145 to secure brace 145 to the ground and turnbuckle 144 correspondingly adjusted in accordance with conventional practice for corresponding adjusting the vertical angle of first panel 101 as needed to ensure a desired vertical orientation of the hardenable material 104 to form the wall.

With attention directed to FIG. 5 illustrating a sectional view taken along line 5—5 of FIG. 4, it may be desirable to join or otherwise engage opposing support structures 105 together to hold first and second panels 101 and 102 in place so that the force and weight of the hardenable material or concrete deposited within cavity 103 will not blow out the first and second panels 101 and 102. Shown for the purposes of illustration is an embodiment of a tie rod assembly 150 securing or otherwise joining together opposing support elements 110 of opposing support structures 105. In this embodiment, tie rod assembly 150 includes an elongate tie member 151 having an insert portion 152 with a first end 153 and a second end 154. Also included is a threaded element 155 extending outwardly from second end 154 and terminating with a free end 156. Elongate tie member 151 is receivable by each support element 110 into and through each space 113 and through apertures 160 and 161 formed through first and second panels 101 and 102, respectively, with portions of insert portion 151 to reside within cavity 104 bound by first and second panels 101 and 102 with second end 154 to terminate outboard of cavity 104. So installed, free end 156 of threaded element 155 and first end 153 of insert portion 152 will each terminate at a point outboard of each respective support element 110. To fasten or otherwise secure elongate tie member 151 with each respective support element 110, a threaded mount or wing nut 165 is threadably receivable by threaded element 155 in a direction from free end 156 and securable against a plate 166 mounted with sidewalls 117B and 118B of the respective support element 110 by virtue of a conventional nut and bolt fastening mechanisms or other conventional means upon rotation of wing nut 165 in a predetermined direction. An engagement element or wedge 170 including an elongate body 171 having a free end 172 and a hooked upper end 173 is also provided. Body 171 is receivable into and through a slot 173 formed through insert portion 152 adjacent first end 153 in a direction from free end 172 and may urged downwardly in the direction indicated by the arrowed line B to engage hooked upper end 173 with sidewall 118B to thus securing elongate tie member 151 with each respective support element 110. Insert portion 152 is somewhat tapered toward second end 154 such that after the hardenable material 104 or concrete has dried or cured within cavity 103, tie rod assembly 150 may be disengaged from each respective support element 110 by reversing the foregoing operation and the elongate tie member 151 pulled in the direction indicated by the arrowed line C and consequently removed from the cured hardenable material 104 for reuse. Furthermore, although only one tie rod assembly 150 has been disclosed, FIG. 4 illustrates how a plurality of such tie rod assemblies 150 may be desirable employed in the foregoing manner.

Figure 7:
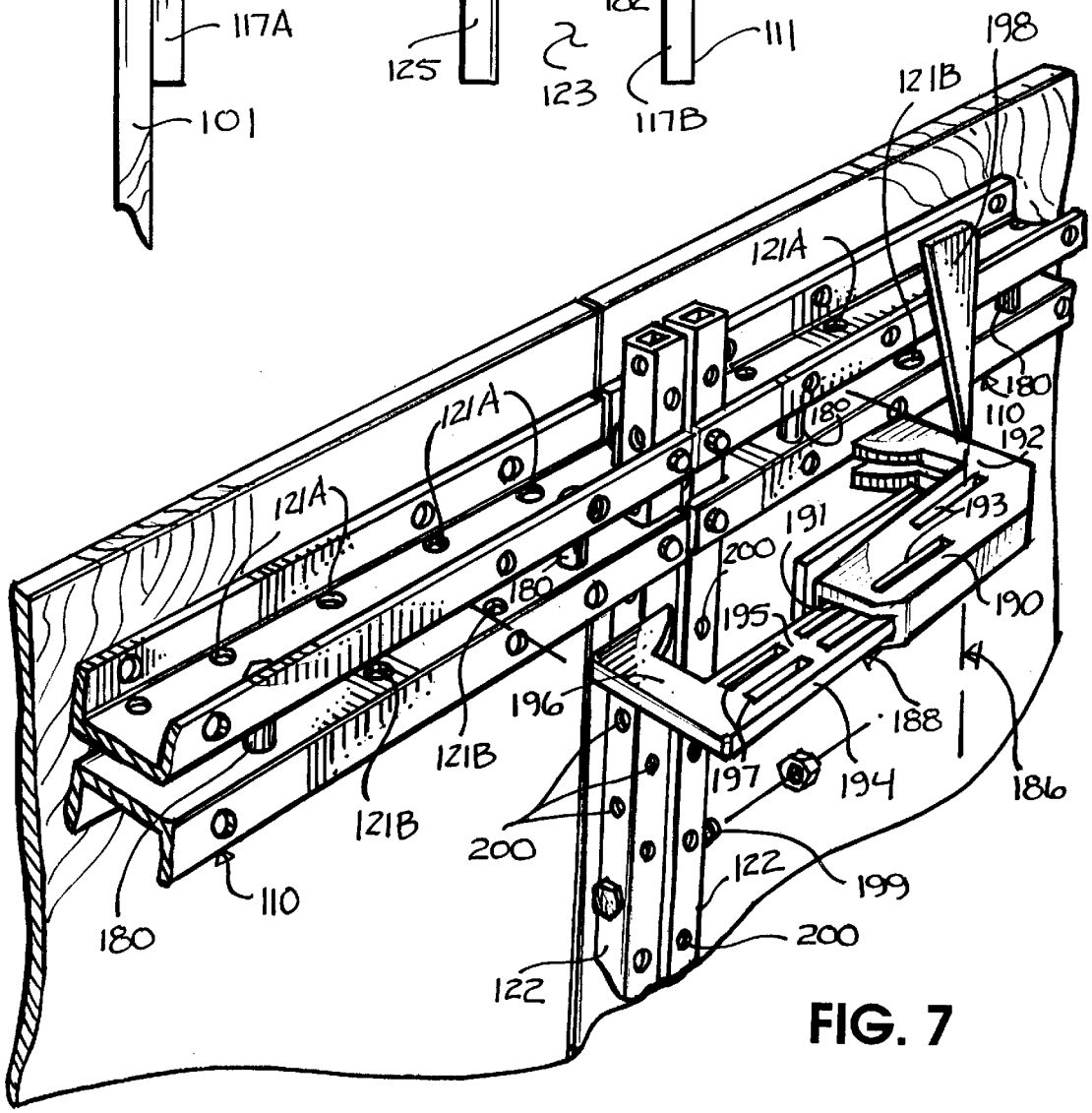
FIG. 7 illustrates an isometric view of adjacent support elements, of the type shown in FIG. 4, positioned in series with a clamp element spaced therefrom and operative for clamping the support elements together.

In FIG. 4, a segment of wall forming system 100 is shown. Normally when forming concrete walls with wall forming system 100 for the purposes of constructing a retaining wall or perhaps a residential or commercial foundation, it will be necessary to construct the concrete wall of varying lengths and heights. To this end, it may be necessary to couple a plurality of support structures 105 together in series. To accomplish this task, attention is first directed back to FIG. 6 illustrating a column 180 carried by support element 110. Column 180 is comprised of a nut 181 and bolt 182 assembly received by opposing apertures 121B (not shown) and fastened with first and second support member 111 and 112 with a sleeve 183 carried by bolt 182 within space 131. With attention directed to FIG. 7, shown is a partial fragmented perspective view of two first support structures 106 shown positioned in linear series with support elements 110 shown positioned end to end in abutting relation with elongate members 122 adjacent one another. Each support element 110 is shown having a column 180 positioned adjacent the ends thereof.

To fasten the adjacent first support structures 106 together, provided is a clamp assembly 186 including a first clamp element 187 and a second clamp element 188 engagable together to operate as a clamp. First clamp element 187 is comprised of a sleeve 190 having an open free end 191 and a hooked outer end 192. Sleeve 190 further includes a plurality of slots 193 formed therethrough at spaced locations. Second clamp element 188 includes a body 194 having a free end 195 and a hooked outer end 196, body 194 having a plurality of slots 197 formed therethrough from hooked outer end 196 to free end 195. Free end 195 of second clamp element 188 is slidably receivable into and through open free end 191 of sleeve 190 of first clamp element 187. Clamp assembly 186 may be coupled with the adjacent support elements 110 with the hooked outer ends 192 and 196 of each respective first and second clamp element 187 and 188 to engage opposing columns 180, the clamp assembly 186 thus to traverse the joint at which the two first support structures 106 meet. Once so engaged, a free end 195 of second clamp element 188 may be slid into and through open free end 191 of sleeve 190 of first clamp element 188. To secure first clamp element 187 with second clamp element 188, a wedge 198 may be driven through one of the slots 193 of sleeve 190 and through an opposing one of the slots 197 carried by body 194 of second clamp element 188 to tighten first and second clamp elements 187 and 188 together thus clamping each support element 110 together about each respective column 180.

It will be readily understood that although only one clamp assembly 186 has been disclosed, a plurality of such clamp assemblies 186 may be provided as needed by the user for secure adjacent support elements 110 together. Additionally, conventional nut and bolt assemblies such as nut and bolt assembly 199 in FIG. 7 may be provided for securing adjacent elongate support elements 122 together to further secure adjacent first support structures 106 together. To this end, each elongate support element 122 may be provided with a plurality of spaced-apart apertures 200 for receiving nut and bolt assemblies at selected and desired locations. Furthermore, although clamp assembly 186 has been disclosed as a preferred embodiment, other conventional clamp mechanisms may be used if desired.

Figure 8:
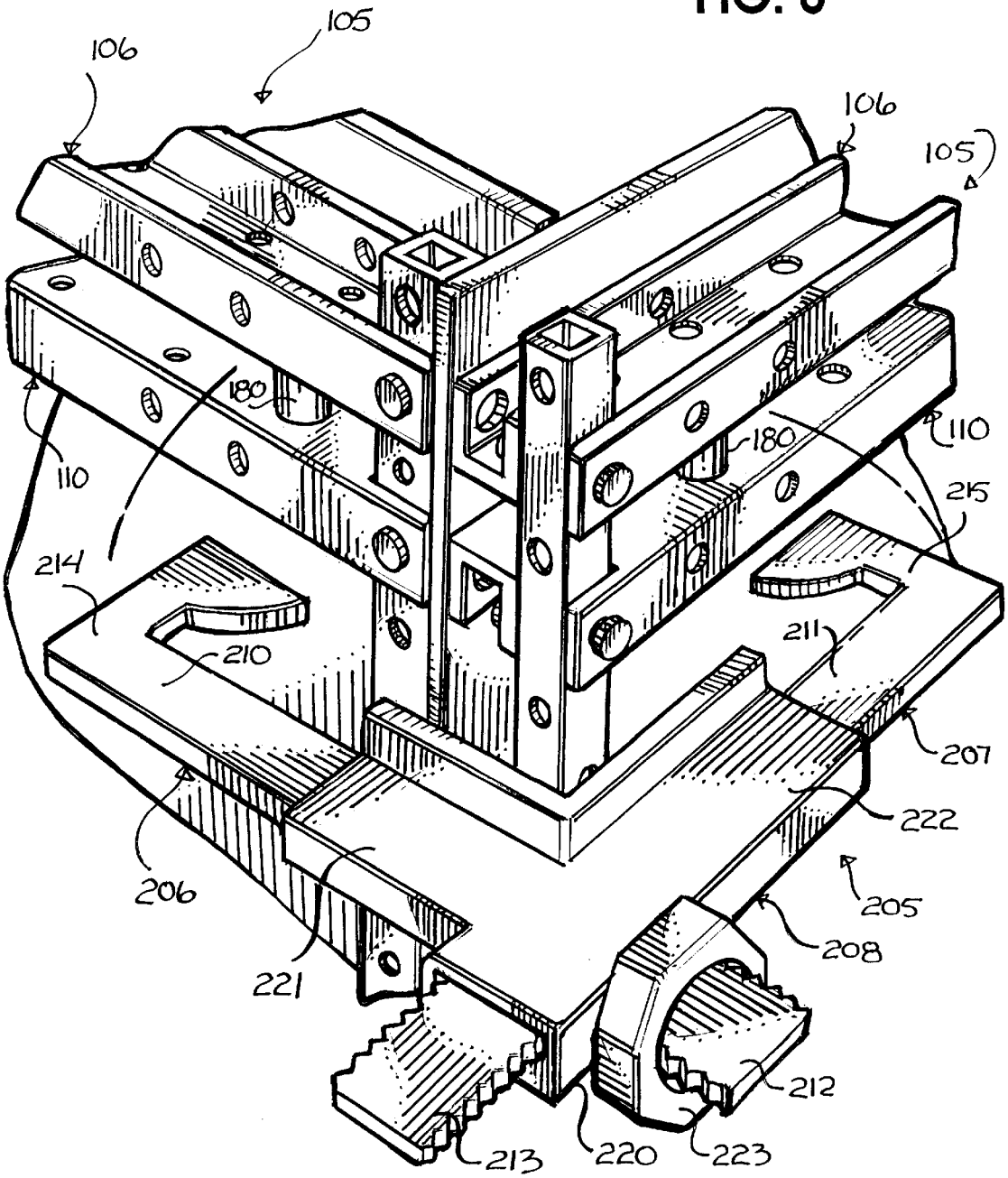
FIG. 8 illustrates a perspective view of a corner clamp operative for engaging opposing angularly disposed support elements of the type shown in FIG. 4.

Consistent with the foregoing, it may be necessary to engage two support structures 105 together at an angle to thus engage forms at an angle to correspondingly form a corner of a wall. In this regard, to couple adjacent support structures 105 together to form a corner, attention is directed to FIG. 8. In FIG. 8, illustrated is a fragmented perspective view of a pair of support elements 110 of respective first support structures 106 joined together at respective ends to form an angle. To secure the support elements 110 together, provided is a clamp assembly 205 including first and second clamp elements 206 and 207 engagable together at an angle with a sleeve element 208. Each clamp element 206 and 207 includes an elongate body 210 and 211 having a threaded free end 212 and 213 and a hooked outer end 214 and 215. Sleeve element 208 includes an integral body 220 having angularly disposed first and second sleeves 221 and 222. The threaded free ends 212 and 213 of each respective first and second clamp element 206 and 207 are receivable through each respective first and second sleeve 221 and 222. With each threaded free end 212 and 213 extending outwardly from first and second sleeve respectively, a threaded mount or bolt 223 (only one shown) may be threadably received by each threaded free end 212 and 213 to secure first and second clamp elements 206 and 207 with sleeve element 208.

Once assembled, clamp assembly 205 may be engaged about the corner formed by adjacent first support structures 106 with each respective hooked outer end 214 and 215 each to engage an adjacent or otherwise opposing column 180 of each respective support element 110. Once so engaged, each threaded bolt 223 (only one shown) may be rotated in a predetermined direction to urge first and second clamp element 207 and 208 inwardly through each respective first and second sleeve 221 and 222 to bear each hooked outer end 214 and 215 against each respective column 180 and secure the support elements 110 together at an angle. Consistent with the nature and scope of the present invention, although clamp assembly 205 has been disclosed as a preferred embodiment, other conventional clamp mechanisms may be used if desired. Furthermore, the foregoing operation may be reversed for disengaging clamp assembly 205 from each first support structure 106.

Figure 9:
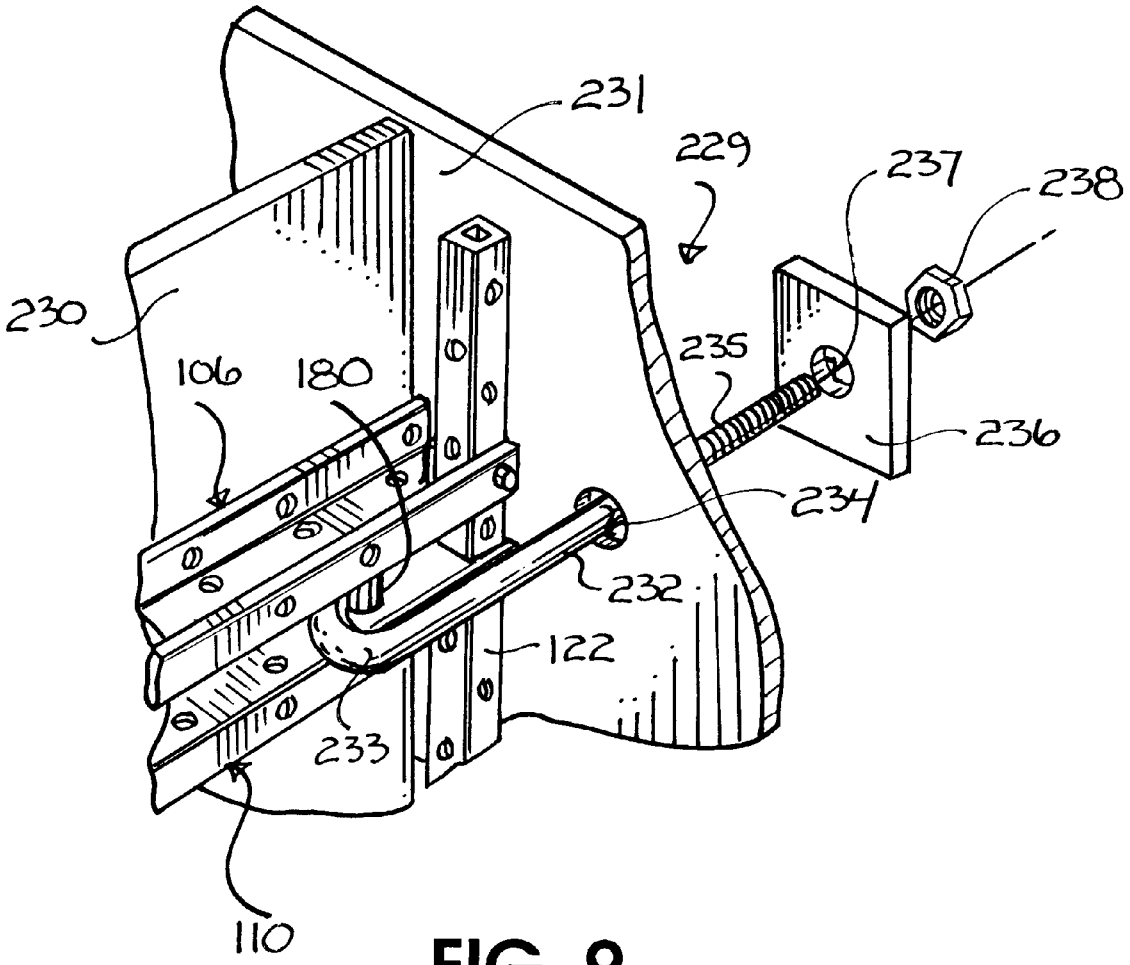
FIG. 9 illustrates a corner clamp operative for engaging a support elements, of the type shown in FIG. 4, with an adjacent form to form a corner.

Although a pair of adjacent first support structures 106 may be engaged in angular relation in the foregoing manner as described in combination with FIG. 8, it may be desirable to engage first support structure 106 with an angularly disposed panel or form in order to form a corner. In this regard, FIG. 9 illustrates a first support structure 106 mounted with a form or panel 230, and another form or panel 231 abutting an edge of panel 230 in angular relation. To engage first support structure 106 with panel 231, provided is a tie assembly 229 comprising an elongate hook element 232 having a hooked end 233 engagable with column 180 carried by support element 110. Elongate hook element 232 extends outwardly from hooked end 233 through an aperture 234 formed through panel 231 and terminates with a threaded portion 235. A washer or plate 236 may be mounted upon threaded portion 235 through an aperture 237 thereof with a threaded nut 238 threadably receivable by threaded portion 235. Nut 238 may be rotated in a predetermined direction and secured against plate 236 to bear against panel 231 to correspondingly secure elongate hook element 232 with panel 231 and first support structure 106 and to thereby secure first support structure 106 with panel 231 in angular relation.

The present invention has been described above with reference to a preferred embodiment. However, those skilled in the art will recognize that changes and modifications may be made in the described embodiments without departing from the nature and scope of the present invention. Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

What is claimed is:

1. A method for forming a cast for molding hardenable material, comprising the steps of:

providing a first panel;

providing a second panel opposing said first panel to bound a cavity for receiving hardenable material;

providing an adjustable support structure comprising:

a first element engagable with said at least one of said panels, a second element opposing said first element, an elongate threaded member having a first end mounted with said first element and a second end mounted for adjustment with said second element, and first and second mounts threadably carried by said elongate threaded member on either side of said second element;

mounting said adjustable support structure with at least one of said panels; and rotating at least one of said first and second mounts to impart a contour to said at least one of said panels.

2. The method of claim 1, wherein either said steps of providing a first panel and providing a second panel further includes the steps of providing a somewhat flexible panel to permit the formation of said contour upon the step of rotating.

3. A method for forming a cast for molding hardenable material, comprising the steps of:

providing a first panel;

providing a second panel opposing said first panel to bound a cavity for receiving hardenable material;

providing first and second adjustable support structures each comprising:

a first element engagable with either said first and second panels, a second element opposing said first element, an elongate threaded member having a first end mounted with said first element and a second end mounted for adjustment with said second element, and first and second mounts threadably carried by said elongate threaded member on either side of said second element;

mounting said first and second adjustable support structures with either one of said panels; and rotating at least one of said first and second mounts of at least one of said first and second adjustable support structures to impart a contour to either one of said first and second panels.

4. The method of claim 3, further including the step of substantially rigidly connecting said first adjustable support structure with said second adjustable support structure.

5. The method of claim 3, wherein either said steps of providing a first panel and providing a second panel further includes the steps of providing a somewhat flexible panel to permit the formation of said contour upon the step of rotating.

* * * * *